US005125582A

United States Patent [19]

Surjaatmadja et al.

[11] Patent Number: 5,125,582

[45] Date of Patent: Jun. 30, 1992

[54] SURGE ENHANCED CAVITATING JET

[75] Inventors. Jim B. Surjaatmadja; John J. Howlett, Jr., both of Duncan, Okla.

[73] Assignee: Halliburton Company, Duncan, Okla.

[21] Appl. No.: 576,642

[22] Filed: Aug. 31, 1990

[51] Int. Cl.[5] ..... B05B 1/00

[52] U.S. Cl. ..... 239/589; 239/499

[58] Field of Search ..... 239/589, 499; 299/14; 175/67, 339, 340, 393, 424; 134/1, 22.18, 22.12

[56] References Cited

U.S. PATENT DOCUMENTS

| | | | |
|---|---|---|---|
| 3,528,704 | 9/1970 | Johnson, Jr. | 299/14 |
| 3,713,699 | 1/1973 | Johnson, Jr. | 299/14 |
| 3,807,632 | 4/1974 | Johnson, Jr. | 239/104 |
| 4,185,706 | 1/1980 | Baker, III et al. | 239/589 |
| 4,391,339 | 7/1983 | Johnson, Jr. et al. | 239/589 |
| 4,422,882 | 12/1983 | Nelson et al. | 134/22.18 |
| 4,474,251 | 10/1984 | Johnson, Jr. | 175/67 |
| 4,497,664 | 2/1985 | Verry | 134/22.12 |

OTHER PUBLICATIONS

Paper entitled "Flow Visualization and Numerical Simulation of Cavitating Self-Oscillating Jets" by Chahine, et al. of Tracor Hydronautics, Inc., presented at Seventh International Symposium on jet cutting technology, Jun. 26-28, 1984.

Publication entitled "Internal and External Acoustics and Large Structures Dynamics of Cavitating Self-Resonating Water Jets", Chahine et al., of Tracor-Hydronautics printed in Oct. 1987.

Paper entitled "Some Industrial Applications of Cavijet ® Cavitating Fluid Jets" by Conn et al., presented at first U.S. Water Jet Symposium at Colorado School of Mines on Apr. 6-9, 1981.

Article entitled "Removing Marine Growth From Offshore Platforms with Cavitation Water Jets" by Vickers et al., Maritime Industries, Jan./Feb., 1985.

Publication entitled "On the Time Dependence of the Rate of Erosion Due to Impingement or Cavitation" by F. J. Heymann (undated).

*Primary Examiner*—Andres Kashnikow

*Assistant Examiner*—Karen B. Merritt

*Attorney, Agent, or Firm*—James R. Duzan; Neal R. Kennedy

[57] ABSTRACT

A surge enhanced cavitating jet for a fluid jetting system. The cavitating jet includes a nozzle portion having a conical throat followed by a fluid separating section. Immediately downstream from the separating section is a substantially cylindrical surge section. The length and inside diameter of the surge section are sized such that a minimum annular area is defined between the inside diameter of the surge section and the outside of the fluid stream as the fluid discharges from the cavitating jet such that cavitation is contained in the surge volume. The fluid stream does not impinge the inside diameter of the cavitating jet. A jetting system including a pump and valve is also disclosed.

17 Claims, 1 Drawing Sheet

SURGE ENHANCED CAVITATING JET

BACKGROUND OF THE INVENTION

1. Field of the Invention

This invention relates to cavitating fluid jets, and more particularly, to a jet having a surge chamber or section for amplifying cavitation in the fluid flow and limiting coning of the jet. This surge chamber also provides automatic sheathing action on the cavitation to sustain the bubbles in the fluid stream.

2. Description of the Prior Art

The jetting of fluid under high pressures is used for such purposes as cleaning of surfaces or drilling. In some cases, the fluid is projected as a cavitating fluid jet in which a stream of the fluid, such as water, has vapor cavities formed therein. Cavitation is the formation, growth and collapse of the vapor filled cavities or bubbles in the liquid which occur at a level where the local pressure is reduced below the vapor pressure of the liquid. The fluid is projected against a solid surface such that the vapor cavities collapse at the point of impact with sufficient force to cause substantial damage or advantageous erosion. Thus, the surface of an object can be cleaned or machined. Typical cavitating fluid jets are shown in U.S. Pat. Nos. 3,528,704 and 3,713,699 to Johnson, Jr.

Cavitating fluid jets are used both in air and in liquids, such as below the surface of the water in a subsea oil platform cleaning application. When used under water, there are generally no problems, and the fluid stream remains fairly confined as it is projected from the nozzle to the object to be cleaned. However, when cavitating fluid jets are used in air, the cavitation bubbles on the edge of the fluid stream dissipate quickly as the fluid leaves the nozzle. This reduces the amount of collapsing cavities at the point of impact. The shock and destructive force of the cavitating fluid jet is thus reduced. The greater the distance between the nozzle and the point of collapse of the cavitation bubbles, the greater the effect the surrounding atmosphere has on the bubble collapse. This is sometimes referred to as venting of the cavitating fluid jet which can ultimately change the jet into just a stream of liquid drops in a gaseous medium, rather than a plurality of vapor cavities in a liquid medium.

Therefore, a need exists for a cavitating fluid jet which tends to minimize the effect of the dissipation of the cavitation bubbles in the atmosphere. The surge enhanced cavitation jet of the present invention provides a solution to this problem by including a surge chamber or section immediately downstream from the orifice or separating section, wherein the surge chamber acts to amplify the cavitation such that the cavitation bubbles stay with the fluid longer as the stream is discharged from the nozzle and to provide continuous sheathing action for retaining the vapor cavities.

SUMMARY OF THE INVENTION

The surge enhanced cavitating jet of the present invention provides a cavitating jetting apparatus comprising nozzle means for converging flow of a fluid stream and cavitation amplification means for amplifying cavitation of the fluid after it passes through the nozzle means. The jetting apparatus is used as a portion of a jetting system which may include a high pressure pump and a control means for controlling fluid flow discharged from the pump.

The nozzle means in the apparatus of the present invention preferably comprises a tapered throat section and a fluid separating section downstream from the throat section. The separating section may be tapered in an opposite direction from the throat section.

The cavitation amplification means is preferably characterized by a substantially cylindrical surge section downstream from the nozzle means. A length and inside diameter of the surge section are sized such that a diameter of a fluid stream discharged from the nozzle means is less than the inside diameter of the surge section. The inside diameter of the surge section is also sized such that an annular surging volume is defined between the inside diameter and the fluid stream. Preferably, the length of the surge section is greater than approximately three times a minimum diameter in the fluid separating section of the nozzle means.

Preferably, the nozzle means and cavitation amplification means are integrally formed in a body. The body may be mounted in the jetting system in a manner known in the art.

It is an important object of the present invention to provide a cavitating jet nozzle which amplifies cavitation in the liquid discharged from an orifice in the nozzle.

Another object of the invention is to provide a cavitating jet nozzle having a surge chamber or section, downstream from a separating section, for amplifying the cavitation and sheathing the flow to retain the cavitation bubbles.

An additional object of the invention is to provide a surge chamber on a cavitating jet nozzle which provides a means for limiting coning of the jetted stream.

Additional objects and advantages of the invention will become apparent a the following detailed description of the preferred embodiment is read in conjunction with the drawings which illustrate such preferred embodiment.

DESCRIPTION OF THE PREFERRED EMBODIMENT

Figure 1:
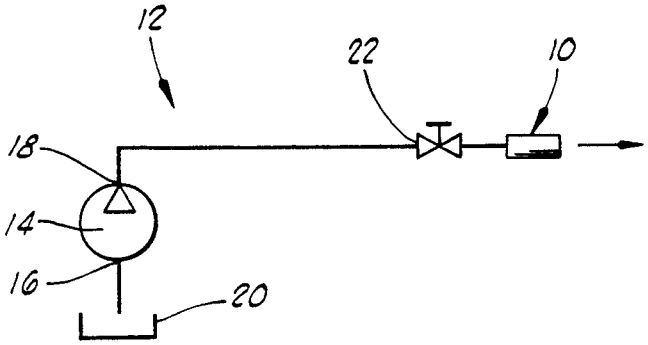
FIG. 1 is a schematic showing a fluid jetting system using the surge enhanced cavitating jet of the present invention.

Referring now to the drawings, and more particularly to FIG. 1, the surge enhanced cavitating jet of the present invention is shown and generally designated by the numeral 10. Jet 10 is shown as part of a jetting system 12.

Except for cavitating jet 10, jetting system 12 is of a kind known in the art having a high pressure jetting pump 14 with an inlet 16 and an outlet 18. Inlet 16 of pump 14 is in communication with a fluid reservoir 20, and cavitating jet 10 is connected to outlet 18. A control valve 22, such as in a hand-held jetting lance, will ordinarily be connected between pump 14 and cavitating jet 10.

Figure 2:
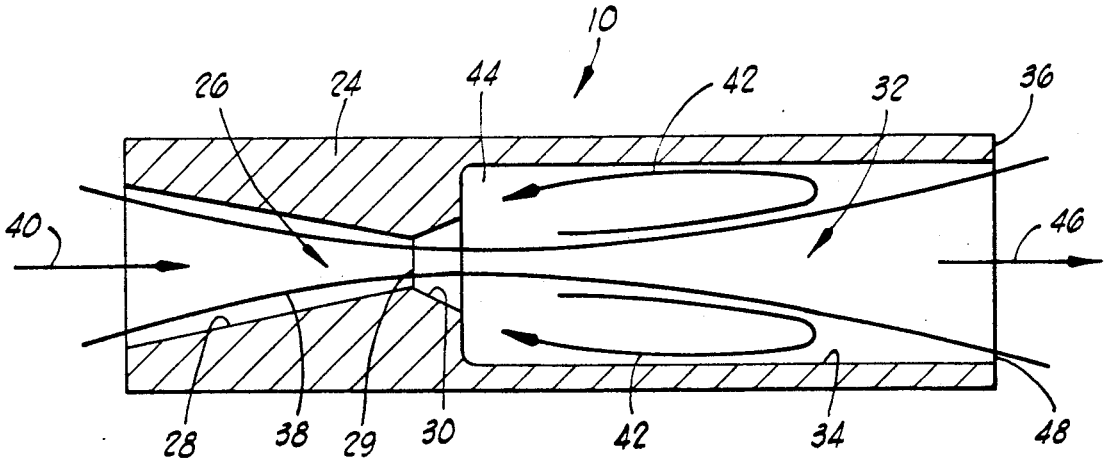
FIG. 2 is a longitudinal cross section of the cavitating jet.

Referring now to FIG. 2, details of cavitating jet 10 are shown. It should be understood that jet 10 may be disposed and retained within a separate housing (not shown), and it may be this housing which is connected to the discharge line from the pump. Such housings are generally known, and it is not intended that the invention be limited to any particular means of connection to jetting system 12.

Jet 10 is preferably integrally formed by a body 24, although it will be seen by those skilled in the art that the various portions of jet 10 herein described might be contained within separate components.

On the inlet side of body 24 is a nozzle means 26 for converging the fluid flowing from pump 14. In the illustrated embodiment, nozzle means 26 is characterized by a substantially conical throat section 28 followed by an orifice 29, followed by a separating chamber or section 30. Separating section 30 is preferably conical, tapering slightly in an opposite direction from throat section 28. It will be seen that the diameter of orifice 29 is the minimum diameter of separating section 30.

Immediately downstream from nozzle means 26 is a cavitation amplifying means, characterized in the drawings by a substantially cylindrical surge chamber or section 34. Surge section 34 opens outwardly at distal outlet end 36 of body 24. The inside diameter of surge section 34 is preferably larger than the maximum inside diameter of separating section 30.

OPERATION OF THE INVENTION

A fluid flow stream 38 from pump 14 enters jet 10 at the inlet of throat section 28, as indicated by flow arrow 40, and is converged as it approaches separating section 30. Initial separation of the fluid flow occurs through separating section 30. That is, cavitating bubbles begin to appear in the fluid in this portion of jet 10.

In jetting nozzles of the prior art, the outlet side of separating section 30 is where the fluid flow would be discharged in a conical stream from the nozzle. In the present invention, the fluid then enters surge section 34 where the flow stream tends to flair out in a conical manner while still within cavitating jet 10. The flow stream is smaller than the inside diameter of surge section 34, and fluid surging, indicated by flow arrows 42, occurs in a generally annular volume 44 defined around flow stream 38. This surging amplifies the cavitation, causing bubble sizing increase and also causing more cavitation bubbles to occur in flow stream 38.

Surge section 34 also insures that a sheath of liquid is maintained around flow stream 38 as it passes therethrough. This sheathing action assists in keeping the cavitation bubbles away from the edge of the flow stream so that they do not dissipate quickly a the flow stream is discharged from surge section 34.

The sheathed flow stream with amplified cavitation is then discharged out of cavitating jet 10 at end 36 of body 24, as indicated by flow arrow 46. The cavitating jetting stream subsequently impacts whatever object is desired to be cleaned or machined. Because the cavitation has been amplified and because the cavitation bubbles do not dissipate as quickly, the cleaning or machining is much more efficient than with prior art nozzles.

The surging fluid in annular volume 44 also acts as a directing means for directing fluid stream 38 toward end 36 of body 24 and limiting the coning of the jetted stream. Preferably, the length and inside diameter of surge section 34 in relationship to separating section 30 is such that the approximate cross-section diameter of the conical fluid stream 38 exiting end 36 is slightly smaller than the inside diameter of surge section 34 such that an annular area 48 is defined therebetween. Annular area 48 is preferably of a size such that the inside diameter of surge section 34 is close enough to flow stream 38 to substantially contain the cavitation in annular volume 44, but not so small that fluid stream 38 will impinge on the inside diameter of surge section 34 which would reduce the fluid velocity.

Testing has indicated that the desired effect of the present invention is not achieved when the length of surge section 34 is approximately three times the diameter of orifice 29 or less. In other words, in the preferred embodiment, the length of surge section 34 in the present invention is greater than approximately three times the diameter of orifice 29 or the minimum diameter of separating section 30. Tests carried out on cavitating jet 10 wherein the length of surge section 34 was eight times the diameter of orifice 29 and wherein the length of the surge section was ten times the diameter of the orifice have shown greatly increased effectiveness of cavitating jet 10, as compared to the same nozzle without a surge section 34.

Cavitating jet 10 will discharge a sheathed fluid stream with amplified cavitation and limited coning, and the cavitation in the stream will not dissipate nearly as quickly in air as is the case with prior art jets. In this way, cavitating jet 10 is much more efficient and effective for cleaning and machining operations.

It will be seen, therefore, that the surge enhanced cavitating jet of the present invention is well adapted to carry out the ends and advantages mentioned, as well as those inherent therein. While the presently preferred embodiment of the invention has been shown for the purposes of this disclosure, numerous changes in the arrangement and construction of parts and features may be made by those skilled in the art. All such changes are encompassed within the scope and spirit of the appended claims.

What is claimed is:

1. A cavitating jetting apparatus comprising:

nozzle means for converging flow in a fluid stream, said nozzle means comprising:

a conical throat section; and a fluid separating section downstream from said throat section; and cavitation amplification means for amplifying cavitation of said fluid after it passes through said nozzle means, said cavitation amplification means being characterized by a substantially cylindrical surge section downstream from said nozzle means and having a length greater than approximately three times the minimum diameter of said nozzle means.

2. The apparatus of claim 1 wherein said separating section is tapered in an opposite direction from said throat section.

3. The apparatus of claim 1 wherein a length and inside diameter of said surge section are sized such that a diameter of a fluid stream discharged from said nozzle means is less than said inside diameter of said surge section.

4. The apparatus of claim 1 wherein said nozzle means and cavitation amplification means are integrally formed in a body.

5. A cavitating jet comprising:

a fluid separating section;

a substantially conical throat upstream from said fluid separating section and tapering inwardly toward an outlet end thereof; and a substantially cylindrical surge section downstream of said fluid separating section, said surge section having an inside diameter larger than an inside diameter of said fluid separating section and having a length greater than approximately three times a minimum diameter of said fluid separating section.

6. The jet of claim 5 wherein said fluid separating section is substantially conical and tapers outwardly toward an outlet end thereof.

7. The jet of claim 5 wherein said surge section is sized such that an annular volume is defined between said inside diameter of said surge section and a fluid flow stream passing therethrough.

8. The jet of claim 5 wherein said inside diameter of said surge section is sized that said fluid stream does not directly impinge said inside diameter.

9. A fluid jetting system comprising:

a pump having an inlet adapted for connection to a fluid reservoir and an outlet;

flow control means in communication with said outlet of said pump for controlling fluid discharged therefrom; and a cavitating jet in communication with said control means and comprising:

nozzle means for converging a fluid stream flowing therethrough, said nozzle means comprising:

a substantially conical throat section tapering inwardly toward an outlet end thereof; and a fluid separating section adjacent to said outlet end of said throat; and amplifying means downstream from said nozzle means for amplifying cavitation in said fluid stream, said amplifying means being characterized by a substantially cylindrical surge section adjacent to an outlet of said nozzle means and having a length greater than about three times a minimum diameter of said nozzle means.

10. The system of claim 9 wherein said surge section is sized such that an inside diameter thereof is not impinged by said fluid stream.

11. The system of claim 9 wherein said separating section is substantially conical and tapers outwardly toward an outlet thereof.

12. A cavitating jetting apparatus comprising:

nozzle means for converging flow of a fluid stream; and cavitation amplification means for amplifying cavitation of said fluid after it passes through said nozzle means, said cavitation amplification means being characterized by a substantially cylindrical surge section downstream from said nozzle means and having a length at least approximately eight times a minimum diameter of said nozzle means.

13. The apparatus of claim 12 wherein said length of said surge section is in the range of about eight to ten times said minimum diameter of said nozzle means.

14. A cavitating jet comprising:

a fluid separating section; and a substantially cylindrical surge section downstream of said fluid separating section, said surge section having an inside diameter larger than an inside diameter of said fluid separating section and having a length at least approximately eight times the minimum diameter of said fluid separating section.

15. The jet of claim 14 wherein said length of said surge section is in the range of about eight to ten times a minimum diameter of said fluid separating section.

16. A fluid jetting system comprising:

a pump having an inlet adapted for connection to a fluid reservoir and an outlet;

flow control means in communication with said outlet of said pump for controlling fluid discharged therefrom; and a cavitating jet in communication with said control means and comprising:

nozzle means for converging a fluid stream flowing therethrough; and amplifying means downstream from said nozzle means for amplifying cavitation in said fluid stream, said amplifying means being characterized by a substantially cylindrical surge section adjacent to an outlet of said nozzle means and having a length at least about eight times a minimum diameter of said nozzle means.

17. The system of claim 16 wherein said length of said surge section is in the range of about eight to ten times greater than a minimum diameter of said nozzle means.

* * * * *